US007082880B2

(12) United States Patent
Schertler

(10) Patent No.: US 7,082,880 B2
(45) Date of Patent: Aug. 1, 2006

(54) ASSEMBLY FOR FASTENING A TRANSPORTATION DEVICE OF A CABLEWAY SYSTEM ON A SUSPENSION BAR

(75) Inventor: Kurt Schertler, Wolfurt (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 11/119,253

(22) Filed: Apr. 29, 2005

(65) Prior Publication Data

US 2006/0060107 A1 Mar. 23, 2006

(30) Foreign Application Priority Data

Sep. 23, 2004 (AT) ..... A 1595/2004

(51) Int. Cl.
*B61B 3/00* (2006.01)
*B61B 7/00* (2006.01)

(52) U.S. Cl. ..... 105/149.1

(58) Field of Classification Search ..... 104/89, 104/90, 91, 112, 115, 116, 118; 105/141, 105/148, 149, 149.1, 149.2, 151
See application file for complete search history.

(56) References Cited

U.S. PATENT DOCUMENTS

| | | | | |
|---|---|---|---|---|
| 4,280,411 | A * | 7/1981 | Katayose et al. | 104/112 |
| 6,427,601 | B1 * | 8/2002 | Albrich | 104/87 |
| 6,862,998 | B1 * | 3/2005 | Doppelmayr | 105/149.1 |
| 2002/0007757 | A1 * | 1/2002 | Meindl | 104/89 |

* cited by examiner

*Primary Examiner*—Sherman Basinger
*Assistant Examiner*—Robert J. McCarry, Jr.
(74) *Attorney, Agent, or Firm*—Laurence A. Greenberg; Werner H. Stemer; Ralph E. Locher

(57) ABSTRACT

An assembly for fastening a transportation device of a cableway system, such as a cabin or a chair, on a suspension bar, which is formed at its upper end with a running mechanism, with a coupling clamp, interacting with the conveying cable or traction cable of the cableway system, and with a guide roller, the transportation device also being provided at its upper end with a supporting device, by way of which it is articulated on the lower end of the suspension bar in a way allowing it to be pivoted transversely with respect to the conveying cable or traction cable. The articulation of the transportation device on the lower end of the suspension bar is formed by two links, which are located at a distance from each other transversely in relation to the conveying cable or traction cable and run obliquely upward in relation to each other, their free ends being articulated on the one hand on the supporting device and on the other hand on the lower end of the suspension bar.

11 Claims, 5 Drawing Sheets

ASSEMBLY FOR FASTENING A TRANSPORTATION DEVICE OF A CABLEWAY SYSTEM ON A SUSPENSION BAR

BACKGROUND OF THE INVENTION

Field of the Invention

The present invention relates to a assembly for fastening a transportation device of a cableway system, such as agondola, or a lift chair, on a suspension bar, which is formed at its upper end with a running mechanism, with a coupling clamp, interacting with the conveying cable or traction cable of the cableway system, and with a guide roller. The transportation device is provided at its upper end with a supporting device, by means of which it is articulated on the lower end of the suspension bar in a way that enables the transport device to be pivoted transversely with respect to the conveying cable or traction cable.

Prior art cableway systems have a conveying cable or traction cable, which in the stations is guided over deflection pulleys, at least one of the deflection pulleys being formed with a drive. It is possible by means of the conveying cable or the traction cable to move transportation means, such as chairs or cabins, which can be coupled to the latter by means of coupling clamps. The transportation devices are respectively located on the lower end of a suspension bar, which is formed at its upper end with a running mechanism, with the coupling clamp and with a guide roller. The transportation devices are articulated on the lower end of the suspension bar in such a way that they can be pivoted about an axis aligned approximately parallel to the conveying cable or traction cable.

Along the length of the cableway system, the transportation devices are coupled by means of the coupling clamp to the conveying cable or traction cable, by which they are moved from the valley station to the mountain station or from the mountain station to the valley station at the speed of the conveying cable or traction cable of 5 m/sec to 6 m/sec. In the stations, the transportation devices are uncoupled from the conveying cable or traction cable and are moved by means of conveying wheels along guide rails through the stations at a speed of approximately 0.5 m/sec. Since the movement of the transportation device through the stations takes place at a significantly lower speed in comparison with the speed of the conveying cable or traction cable, the transportation device can be entered or left by the passengers.

Since, when they enter the stations, the transportation devices are still coupled to the conveying cable or traction cable, they can perform pivoting movements about the axis of the latter, transversely in relation to it. Since, however, it must be ensured that the running mechanisms reach the guide rails, there is the requirement to form the suspension bars with guide rollers to which guiding rails of a flared configuration are assigned at the entrances to the stations, with the effect of pivoting the transportation device fastened on the suspension bars into an approximately vertical position.

Since, on the lower end of the suspension bar, the transportation devices are fastened such that they can pivot about an axis extending approximately in the direction of the conveying cable or traction cable, pivoting of the suspension bar by means of the guiding rail provided in the region of the entrance to the station has the effect that, on account of the moment of inertia with respect to the suspension bar, the transportation devices first perform a contrary pivoting movement and only subsequently swing into an approximately vertical position. These pivoting movements occurring on entering the stations, caused by the previously used articulation of the transportation device on the lower end of the suspension bar, constitute an impairment of the traveling comfort for the passengers because strong pivoting of the transportation device, and subsequently several swinging movements of the same, occur as a result. Since, moreover, the pivoting axis of the transportation device that is decisive in this respect is located at the upper ends of the latter, the transportation device can adopt extremely skewed positions.

SUMMARY OF THE INVENTION

It is accordingly an object of the invention to provide a system for fastening the transportation device to a suspension bar which overcomes the above-mentioned disadvantages of the heretofore-known devices and methods of this general type.

With the foregoing and other objects in view there is provided, in accordance with the invention, an assembly for fastening a transportation device of a cableway system on a suspension bar, comprising:

a supporting device mounted to a top side of the transportation device; and two links mounting the supporting device of the transportation device to a lower end of the suspension bar for articulation of the transportation device transversely to a travel direction of the transportation device;

the links being disposed spaced apart transversely to the travel direction and running obliquely upward relative to each other, and the links having lower free ends articulated on the supporting device and upper free ends articulated on the lower end of the suspension bar.

In other words, the objects of the invention are achieved by the fact that the articulation of the transportation device on the lower end of the suspension bar is formed by two links, which are located at a distance from each other transversely in relation to the conveying cable or traction cable and run obliquely upward in relation to each other, their free ends being articulated on the one hand on the supporting device and on the other hand on the lower end of the suspension bar.

The links according to the invention achieve the effect on the one hand that, when there is pivoting of the suspension bar brought about by the guiding rails when the transportation device enters the station, the transportation device is pivoted in the same direction, whereby contrary pivoting of the same is avoided. Since, moreover, the mutual alignment of the two links has the effect that the imaginary pivoting axis is far above the transportation device, it adopts less extreme skewed positions in this pivoting movement in comparison with the previous type of fastening. On account of these two circumstances, greatly increased traveling comfort is brought about.

The imaginary point of intersection of the two links in the rest position of the transportation device is preferably located in a region above the lower end of the suspension bar.

Furthermore, the two links are preferably formed in pairs, the two parts of a pair respectively being located laterally outside the lower end of the suspension bar. In this case, the two parts of a pair of links can be connected to each other by web plates.

According to a preferred embodiment, the two links form with each other an included angle of 10° to 50°, in particular of approximately 25° to 30°. Furthermore, at least one damping element may be provided between the lower end of the suspension bar and the supporting device; the damping element may be formed by at least one shock absorber arranged between the lower end of the suspension bar and the supporting device and at least one damping device may be provided between the supporting device and the transportation device.

The lower end of the suspension bar is preferably aligned approximately horizontally.

Other features which are considered as characteristic for the invention are set forth in the appended claims.

Although the invention is illustrated and described herein as embodied in a assembly for fastening a transportation device of a cableway system on a suspension bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
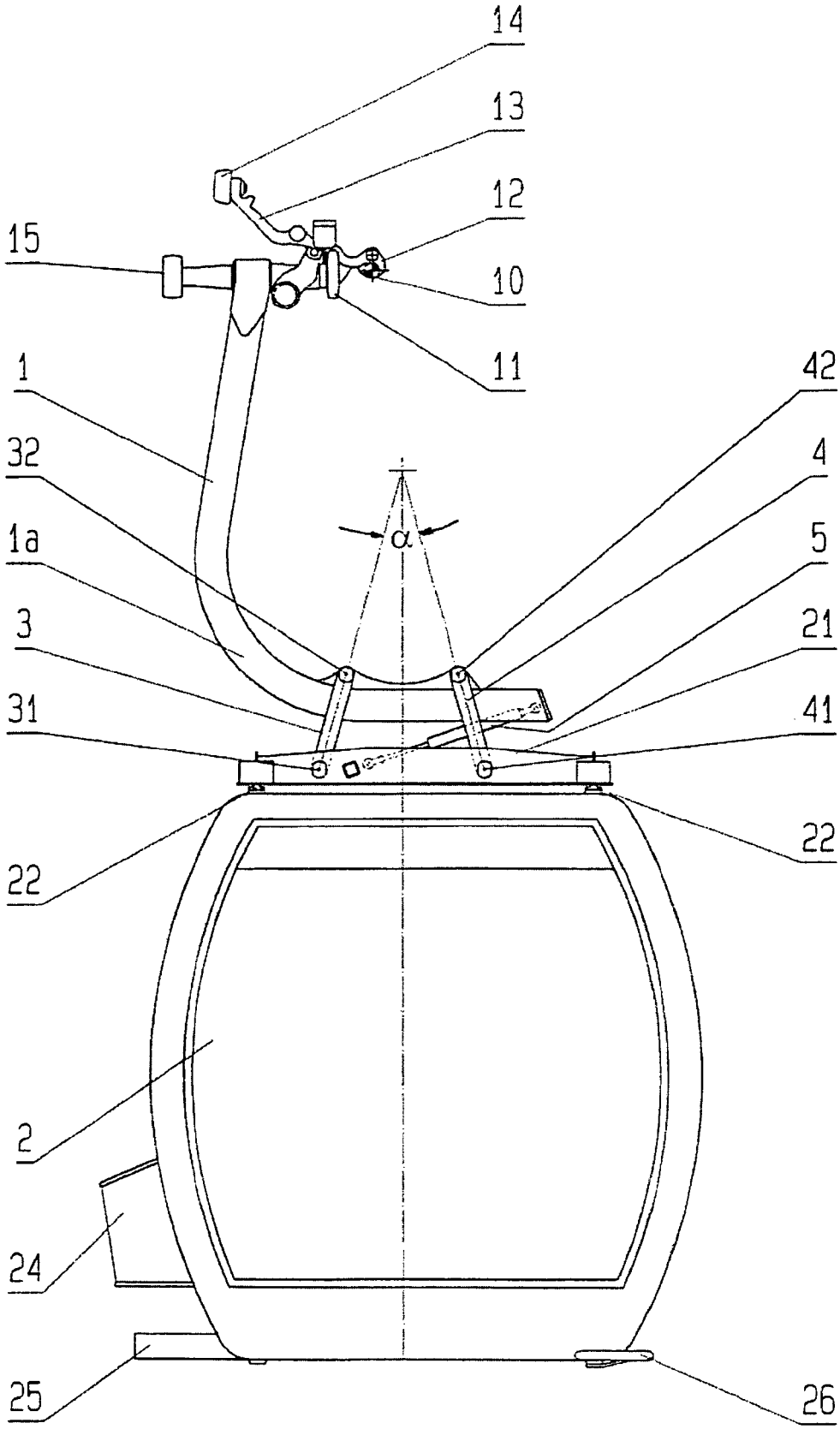
FIG. 1 shows a cableway cabin of a cableway system fastened on a suspension bar by means of a device according to the invention, seen in the direction of movement of the conveying cable or traction cable.

Referring now to the figures of the drawing in detail and first, particularly, to FIG. 1 thereof, there is seen a cabin 2 of a cableway system fastened on the lower end part 1*a* of a suspension bar 1. At the upper end of the suspension bar 1 there is a running mechanism 11, a coupling clamp 12, which can be actuated by a coupling lever 13 by means of a control roller 14, and a guide roller 15, which is assigned to guiding rails in the stations of the cableway system. The lower end part 1*a* of the suspension bar 1 is aligned approximately horizontally. By means of the coupling clamp 12, the cableway cabin 2 fastened on the lower end part 1*a* of the suspension bar 1 can be coupled to the conveying cable 10 or to the traction cable of the cableway system.

The cableway cabin 2 is formed on its upper side with a supporting framework 21, which is fastened to the cableway cabin 2 with spring elements 22 interposed. The fastening of the cableway cabin 2 on the lower end part 1*a* of the suspension bar 1 takes place by means of two links 3 and 4, which are mounted with their two ends at bolts 31, 32 and 41, 42, on the one hand on the supporting framework 21 and on the other hand on the lower end part 1*a* of the suspension bar. Since the bearing bolts 31 and 41 located in the supporting framework 21 are located at a greater distance from each other than the bearing bolts 32 and 42 are located from each other, the links 3 and 4 form with each other in the upward direction an acute angle $\alpha$ of approximately 30°. Also arranged between the lower end part 1*a* of the suspension bar and the supporting framework 21 is a shock absorber 5.

The cableway cabin 2 is also formed with a container 24 for holding skiers and with laterally protruding guiding skids 25 and 26. The guiding skid 25 also serves as a stepping plate.

Figure 2:
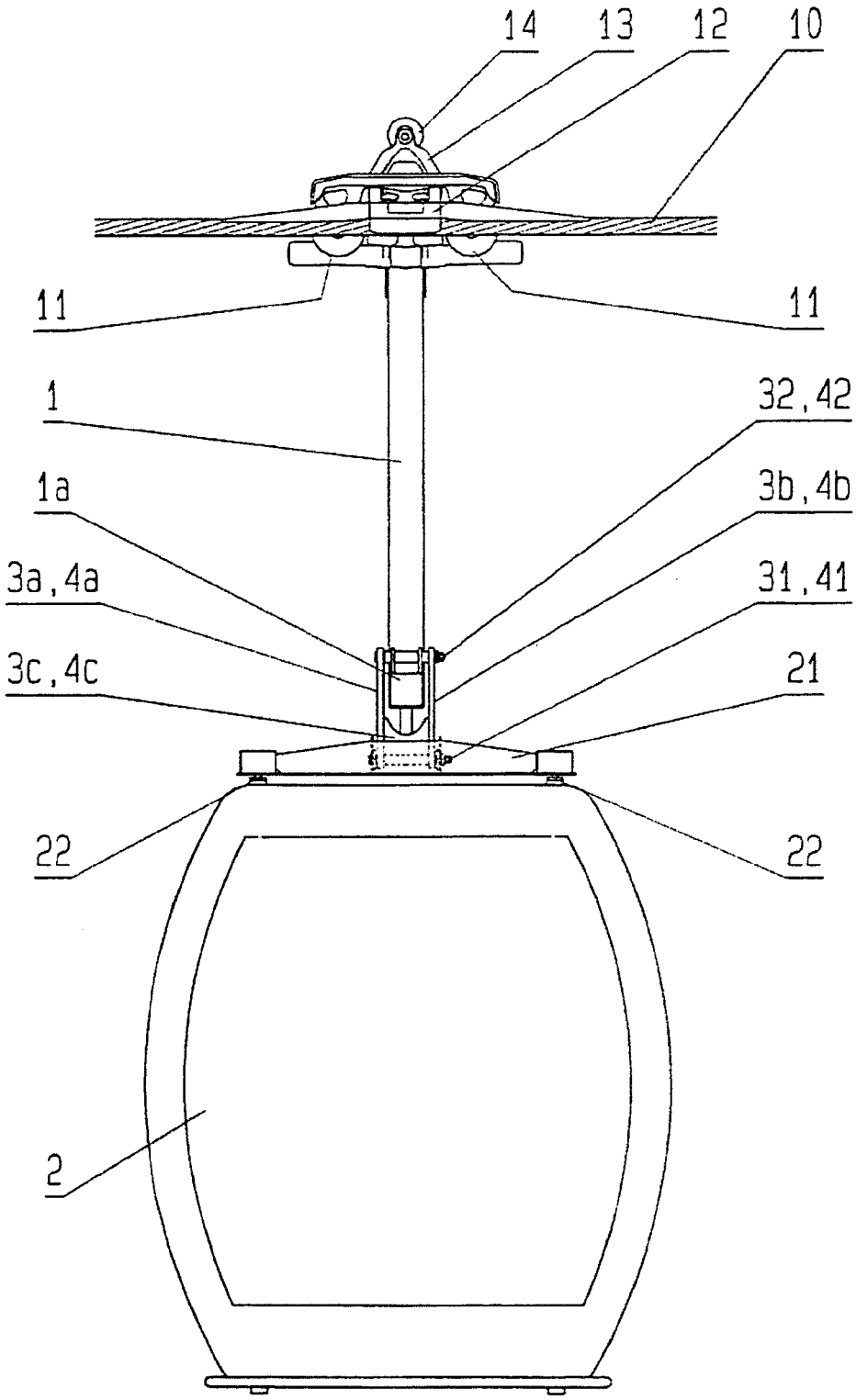
FIG. 2 shows the cableway cabin fastened on the suspension bar, seen transversely in relation to the direction of movement of the conveying cable or traction cable.

As can be further seen from FIG. 2, the links 3 and 4 are respectively formed in pairs, the two parts of a pair 3*a*, 3*b* and 4*a*, 4*b* being located laterally outside the lower part 1*a* of the suspension bar and being connected to each other by means of web plates 3*c*, 4*c*.

Figure 3:
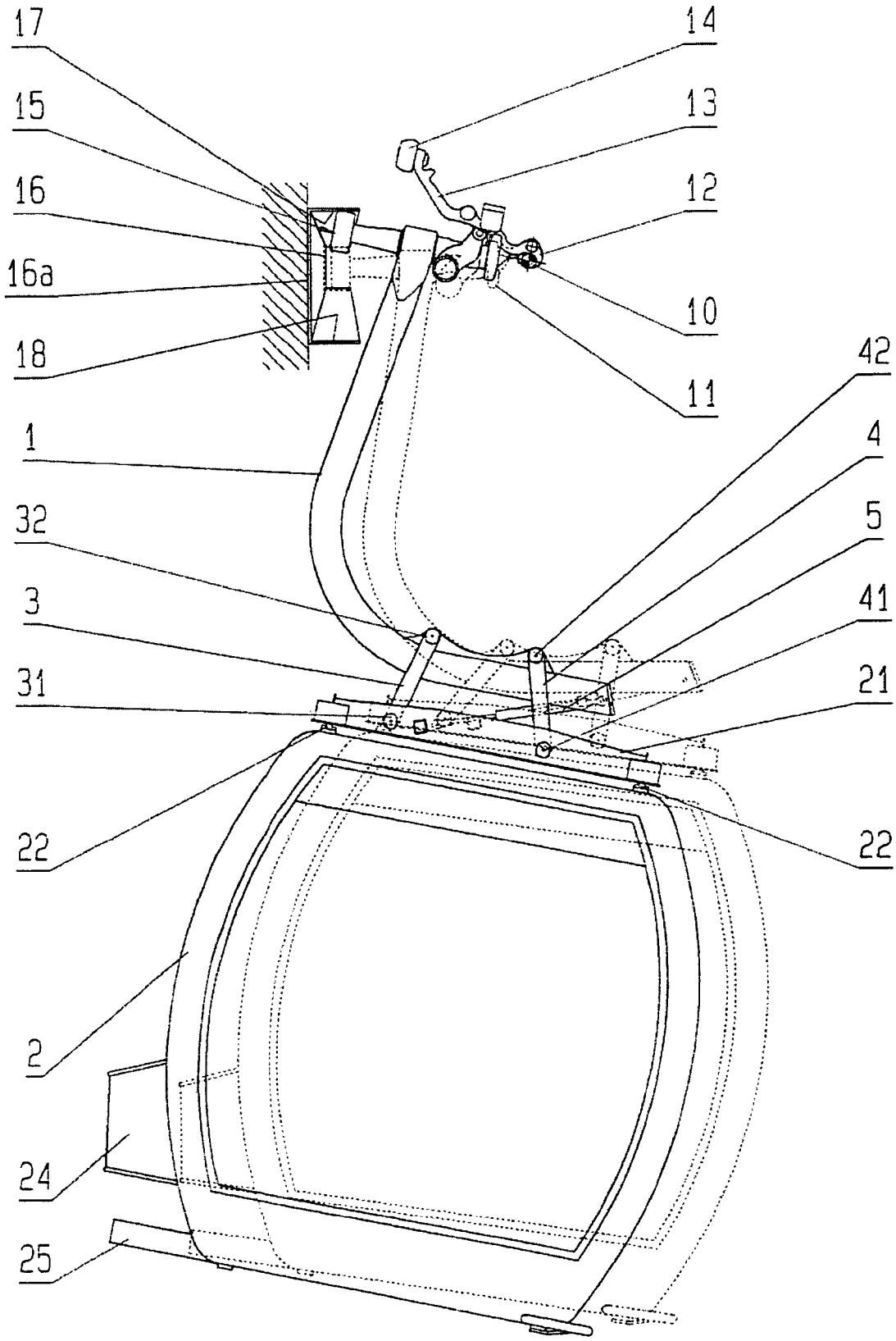
FIG. 3 shows the sequence of movements of a cableway cabin fastened on a suspension bar as it enters a station of the cableway system, seen in the direction of movement of the conveying cable or traction cable.

The operating principle of the device according to the invention for fastening the cableway cabin 2 on the lower end part 1*a* of the suspension bar 1 will now be explained with reference to FIGS. 3 and 4:

The cableway cabins 2 coupled to the conveying cable 10 or traction cable by way of the coupling clamps 12 are conveyed by means of the conveying cable 10 or traction cable, which is moved at speeds of 5 m/sec to 6 m/sec, from a first station, for example the valley station, to a second station, for example the mountain station. In the running-in region of the second station, there is a guiding rail 16, which is assigned to the guide roller 15, is formed at its beginning with a widened opening 16*a* and the running surfaces 17 and 18 of which, acting together with the guide roller 15, come so close to each other along the path of movement that the guide roller 15 is guided both from above and from below. If, on entering the station, the suspension bar 1 and the cableway cabin 2 have a pivoted position in the clockwise direction with respect to the central position, as is represented in FIG. 3, the guide roller 15 comes to bear against the upper running surface 17. Since the two running surfaces 17 and 18 come closer to each other along the path of movement, the suspension bar 1 is pivoted in the counter-clockwise direction, into the position represented by dashed lines. On account of the fastening of the cableway cabin 2 by means of the links 3 and 4, the lower end part 1*a* of the suspension bar 1 and the cableway cabin 2 perform a translatory movement and a pivoting movement respectively in the counter-clockwise direction, with swinging movements largely been avoided. Since, furthermore, the imaginary pivoting point of the cableway cabin 2 is at a great distance from the upper end of the cableway cabin 2, correspondingly minor skewed positions of the cableway cabin 2 occur during the pivoting movement.

Figure 4:
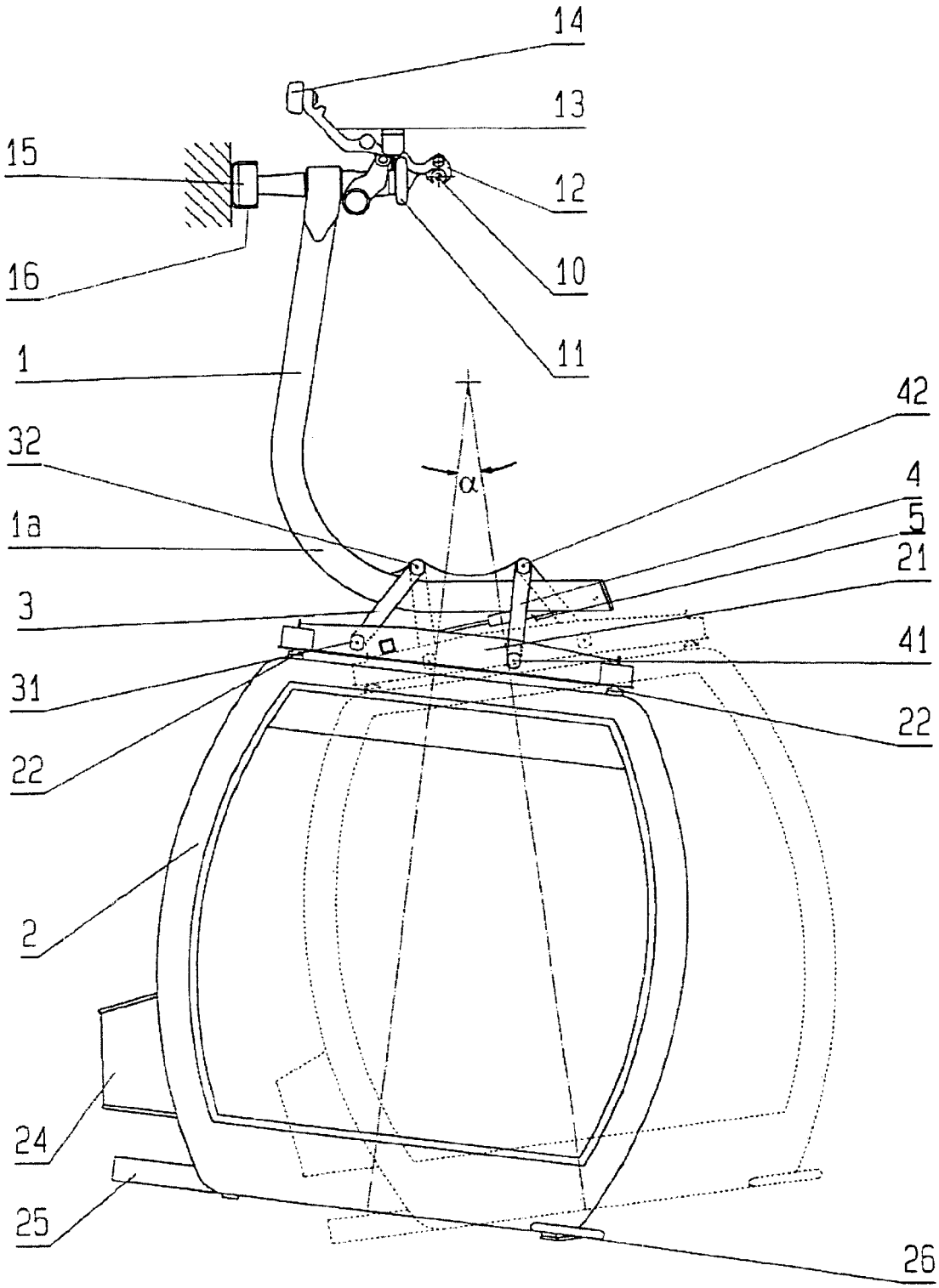
FIG. 4 shows a cableway cabin fastened on a suspension bar and guided in a station, in two possible pivoting positions, seen in the direction of movement of the conveying cable or traction cable.

In FIG. 4, that region of the guiding rail 16 in which the suspension bar 1 uncoupled from the load-bearing and conveying cable 10 is guided by means of the guide roller 15 in such a way that it cannot perform any pivoting movements is represented. On the other hand, the cableway cabin 2 can adopt pivoted positions by means of the links 3 and 4. In this case, however, the maximum skewed positions of the cableway cabin 2 would be significantly less extreme than would be the case if the cabin were able to pivot about a single pivoting pin provided in the end part 1*a* of the suspension bar 1.

Figure 5:
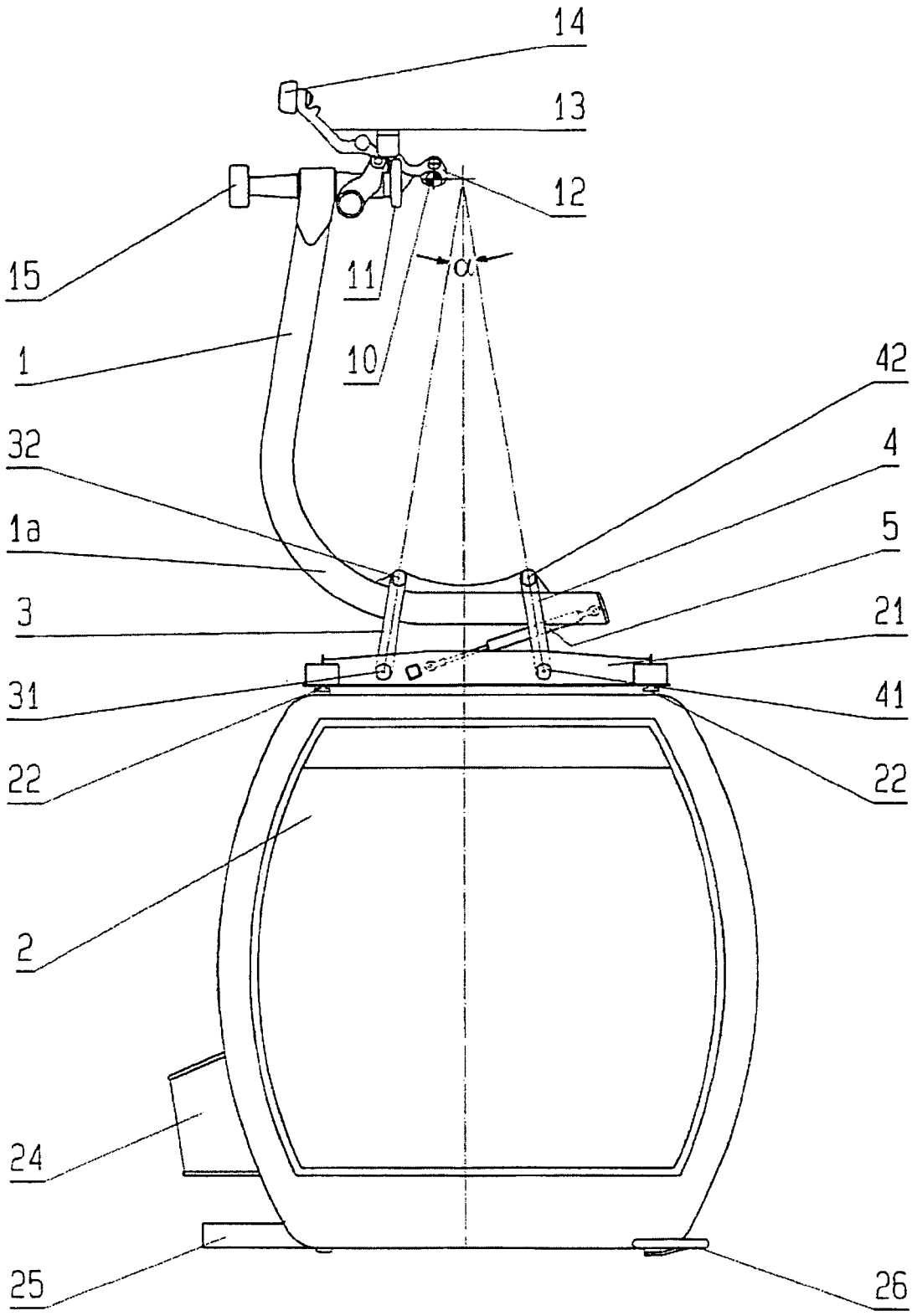
FIG. 5 shows a structural variant of the fastening of the cableway cabin on the lower end of the suspension bar, in a view similar to that of FIG. 1.

In FIG. 5, a variant of the embodiment shown in FIG. 1 to the extent that the two links 3 and 4 form with each other an acute angle a of approximately 25° is represented. Since, as a result, the imaginary pivoting point of the cableway cabin 2 is still further away from the latter, the comfort for the passengers is increased still further.

This application claims the priority, under 35 U.S.C. § 119, of Austrian patent application No. A 1595/2004, filed Sep. 23, 2004; the entire disclosure of the prior application is herewith incorporated by reference.

I claim:

1. An assembly for fastening a transportation device of a cableway system on a suspension bar, comprising:

a supporting device mounted to a top side of the transportation device; and two links mounting said supporting device of said transportation device to a lower end of the suspension bar for articulation of the transportation device transversely to a travel direction of the transportation device;

said links being disposed spaced apart transversely to the travel direction and running obliquely upward relative to each other, and said links having lower free ends articulated on said supporting device and upper free ends articulated on the lower end of the suspension bar, and wherein an imaginary point of intersection of said two links, in the rest position of the transportation device, is located above the lower end of the suspension bar.

2. The device according to claim 1, wherein said two links are formed in pairs, with two parts of a pair respectively located laterally outside the lower end of the suspension bar.

3. The device according to claim 2, which comprises web plates connecting said two parts of a pair of links to one another.

4. The device according to claim 1, wherein said two links enclose an angle of 100° to 50°.

5. The device according to claim 1, wherein said two links enclose an angle of 25° to 30°.

6. The device according to claim 1, which comprises at least one damping element disposed between the lower end of the suspension bar and said supporting device.

7. The device according to claim 6, wherein said damping element is at least one shock absorber between the lower end of the suspension bar and said supporting device.

8. The device according to claim 1, which comprises at least one damping device disposed between said supporting device and the transportation device.

9. The device according to claim 1, wherein the lower end of the suspension bar is aligned approximately horizontally.

10. The device according to claim 1, wherein said transportation device is a cabin or a chair.

11. An assembly for fastening a transportation device of a cableway system to a suspension bar, the suspension bar having an upper end with a running mechanism formed with a coupling clamp for clamping the suspension bar to a conveying or traction cable of the cableway system and with a guide roller, and the suspension bar having a lower end attached to a supporting device mounted to a top side of the transportation device, the assembly comprising:

two links mounting said supporting device of said transportation device to a lower end of the suspension bar for articulation of the transportation device transversely to the conveying or traction cable;

said links being spaced apart in a direction transverse to the conveying or traction cable and extending obliquely upward relative to each other between the supporting device and the lower end of the suspension bar, said links having lower free ends articulated on said supporting device and upper free ends articulated on the lower end of the suspension bar, and an imaginary point of intersection of said two links, in the rest oosition of the transoartation device, being located above the lower end of the suspension bar.

* * * * *